US005681171A

United States Patent [19]

Park

[11] Patent Number: 5,681,171

[45] Date of Patent: Oct. 28, 1997

[54] PIVOTABLE CABLE CONNECTOR

[75] Inventor: Seon-kyu Park, Suwon, Rep. of Korea

[73] Assignee: Samsung Electronics Co., Ltd., Suwon, Rep. of Korea

[21] Appl. No.: 566,949

[22] Filed: Dec. 4, 1995

[30] Foreign Application Priority Data

Dec. 2, 1994 [KR] Rep. of Korea ..... 94-32736

[51] Int. Cl.[6] ..... H01R 39/00

[52] U.S. Cl. ..... 439/31; 439/210

[58] Field of Search ..... 439/446, 13, 31, 439/11, 441, 341, 210

[56] References Cited

U.S. PATENT DOCUMENTS 3,474,376 10/1969 Preiss ..... 439/31

4,959,021 9/1990 Byrne ..... 439/466

FOREIGN PATENT DOCUMENTS 0292769 11/1989 Japan ..... 439/31

*Primary Examiner*—Khiem Nguyen

*Assistant Examiner*—Eugene Byrd

*Attorney, Agent, or Firm*—Banner & Witcoff, Ltd.

[57] ABSTRACT

A multiple pin cable connector for mating with a receptacle is disclosed, in which the connector has housing defining a turning hollow, and a head, the lower body portion of which is inserted in the hollow of the housing. The head includes an engagement portion for mating with the receptacle. The attachment of the head to the housing enables pivoting of the head in first and second directions. Wires connected to a signal cable and contained in the housing are separated and threaded through openings formed along the central axis to contact the corresponding pins for enabling electrical continuity between the cable and the receptacle. The housing and head are coupled by means a pivotable coupling along a central axis, enabling the respective part to pivot in a limited angle. As a result, the housing can be pivoted to be prone to the backside wall of rear case of a monitor so that the signal cable is positioned in parallel with the backside wall, reducing the necessary space for the cable, and presenting a sleeker, enhanced visual appearance.

10 Claims, 3 Drawing Sheets

PIVOTABLE CABLE CONNECTOR

CROSS-REFERENCE TO RELATED APPLICATIONS

This application makes reference to, incorporates herein and claims all benefits accruing under 35 U.S.C. §119 from an application earlier fried in the Korean Industrial Property Office on Dec. 2, 1994, entitled ROTATABLE SIGNAL CABLE PLUG which was duly assigned Ser. No. 94-32736 by that Office.

BACKGROUND OF THE INVENTION

The present invention relates in general to a plug-in connector for an electrical signal cable for use with an electrical component such as a monitor apparatus, and more particularly, to a cable connector for detachably interconnecting a multiple pin signal cable of a multiplicity of electrical lines to a receptacle mounted on a rear case section of a monitor assembly.

Conventionally, a plug connector assembly for electric signal cable comprised a housing 4 and an engageable head 6 as depicted in FIG. 1. Housing 4 incorporates a copper sheet, a plurality of electrically conductive wires 1*a* of a signal cable 1 disposedly accommodated and retained by a molding member 3 that is securely engaged with head 6 for protecting and supporting a plurality of pin contacts 5. A plug of such conventional type construction has an elongated shape, making the exterior of a monitor unsightly and requiring more space.

As illustrated in FIGS. 2(A) and 2(B), the conventional signal cable plug 7 extends out a substantial distance from the back of the rear case section of a monitor so that it may touch a surface of a wall thereby causing a disassembly of the plug when the monitor rotates in use. Furthermore, the protruding plug reduces the visual appearance of the monitor. In addition, a monitor coupled with the conventional plug 7 would require more space to accommodate its radius of rotation when in use at a location close to a wall.

SUMMARY OF THE INVENTION

Therefore, it is an object of the present invention to provide a plug-in cable connector which is pivotable so that less space is occupied when in use. It is another object of the present invention to provide a plug-in cable connector capable of preventing the connector from separating once mated with a receptacle part due to turning of a monitor when in use.

It is still another object of the present invention to provide a plug-in cable connector with a sleek, enhanced visual appearance.

To accomplish the above objects and advantages of the present invention, there is provided a plug-in signal cable connector wherein a housing and a head for accommodating the multiple contact pins are configured so that the head is pivotable in a 180-degree arc.

The above feature and advantage may be more completely understood from the following detailed description of the preferred embodiment of the invention, with reference to the accompanying drawings.

DETAILED DESCRIPTION OF THE PREFERRED EMBODIMENTS

Figure 1:
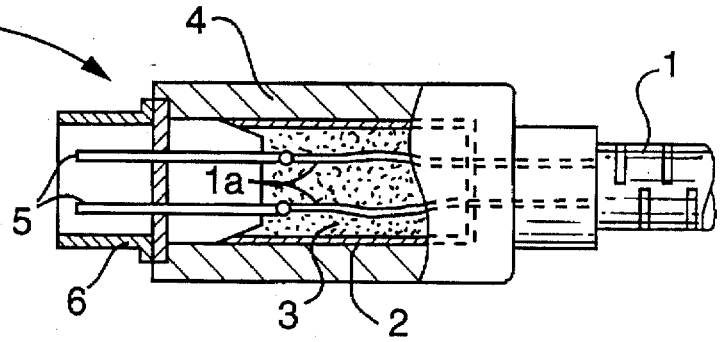
(PRIOR ART) FIG. 1
FIG. 1 is a cross-sectional view of a conventional signal cable plug.
Figure 2A:
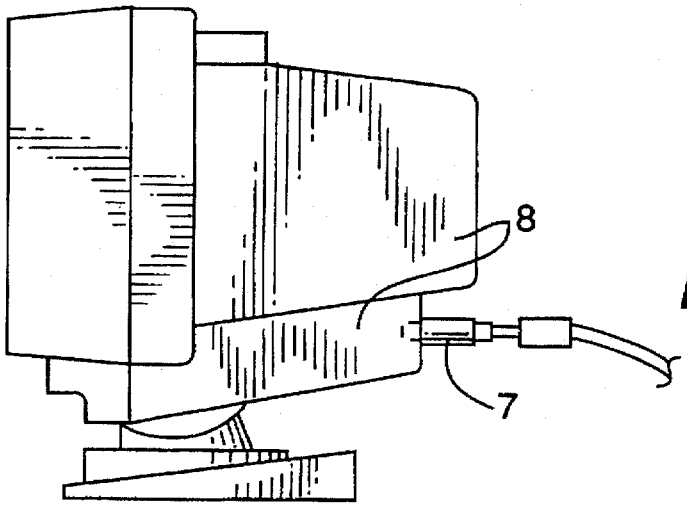
(PRIOR ART) FIG. 2(a)
FIGS. 2(A) and 2(B) are side views of a conventional signal cable plug in use with different monitor assemblies.
Figure 2B:
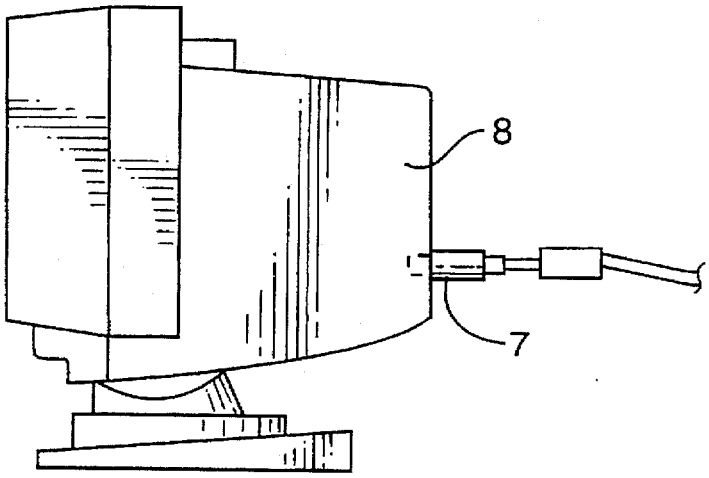
(PRIOR ART) FIG. 2(b)
Figure 3:
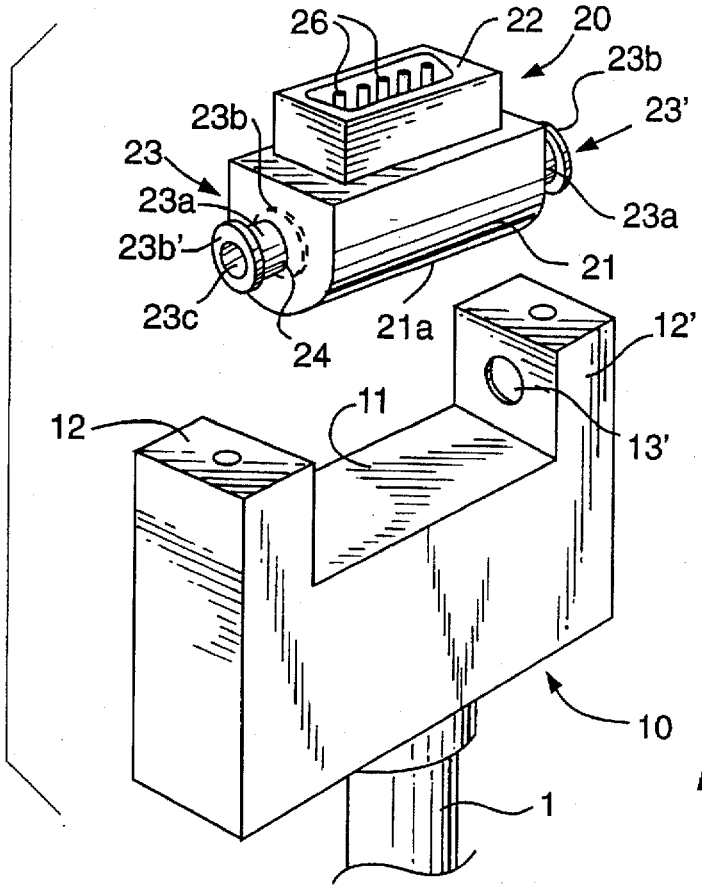
FIG. 3 is an exploded perspective view of a preferred embodiment of the plug-in cable connector according to the principles of the present invention.
Figure 4:
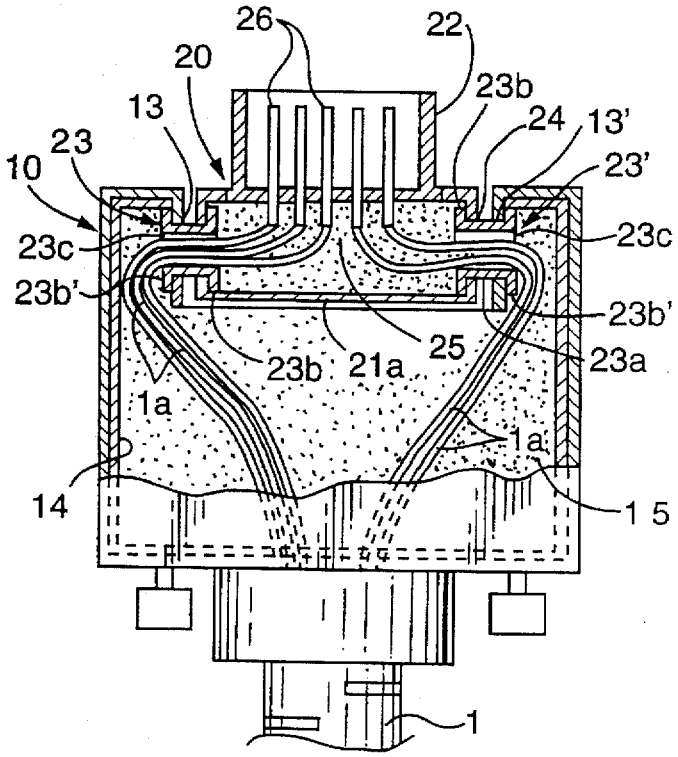
FIG. 4 is a cross-sectional view taken along line 4—4 of the cable connector of FIG. 3 shown assembled.

Referring to FIG. 3, a preferred embodiment of the present invention comprises a coupling broadly made up of a head 20 and a housing 10 connected to an electrical signal cable. Housing 10 is provided with side posts 12, 12' in opposing relation to each other to define a turning hollow 11 therebetween.

Both side posts 12, 12' are provided with respective openings 13, 13' substantially centered on the inner side walls of the posts. Head 20 is comprised of an upper engagement portion 22 and a lower body 21 which is sized and configured to be received within turning hollow 11. The lower body portion 21 is generally rounded, and defines a central axis along the longitudinal direction of the body. Generally, at the center of each of the side walls of body 21, tubular shafts 23, 23', with flanged ends are provided. Shafts 23, 23' are shaped as hollow cylindrical spools, and are inserted into openings 24, 24' of body 21 such that one flanged end of each shaft is disposed within respective posts 12, 12'. Shaft 23 is provided with flanges 23*b* at both ends of its cylindrical body and has an axial opening 23*c* for receiving wires. Wires W of signal cable C are introduced inside housing 10 and are shielded by copper sheet 14 and then processed with molding member 15. Shaft 23' is identical to shaft 23 and thus has corresponding elements indicated by primed reference numerals.

To assemble the free flanged ends of shaft 23, 23' are inserted into openings 13, 13' to engagedly lock flanges 23*b*, 23*b*'. A plurality of wires W coupled to contact pins 26 extend upward from the bottom of head 10, and are securely fixed by molding member 25 to the bottom plate of head 10. Wires W are separated and then threaded through respective axial wire openings 23*c*, 23*c*' of shafts 23, 23' and connected to the corresponding pins 26.

Figure 5:
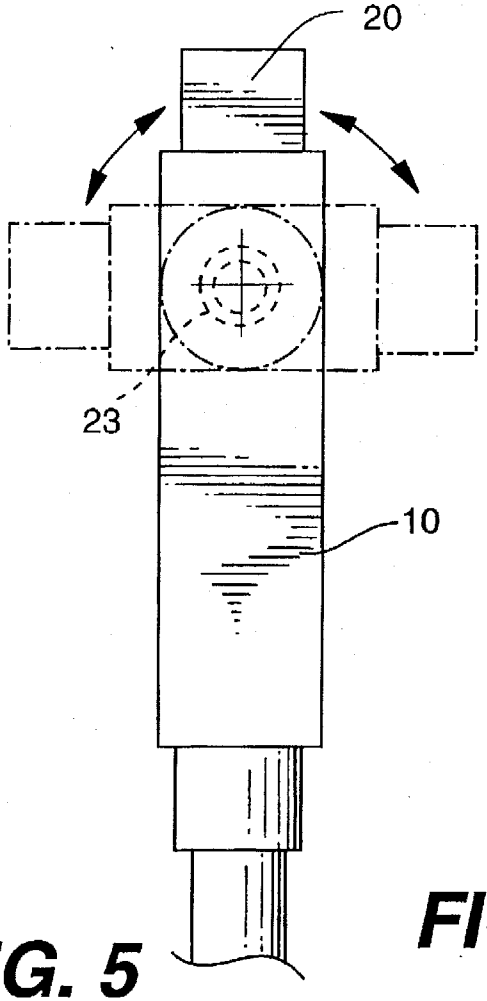
FIG. 5 is a side elevational view of the cable connector of FIG. 3 shown assembled illustrating the operational range of the cable connector.

As seen in FIG. 5, a plug-in cable connector as constructed above is able to pivot in a 180-degree arc since housing 10 and head 20 are jointly coupled by a pair of shafts 23, 23' such that housing 10 is pivotable about the central axis defined by shafts 23, 23' while head 20 remains fixed. The pivot angle range is to a right angle to the left and fight directions from an alignment position of head 20 with housing 10, summing up to 180-degrees.

Figure 6A:
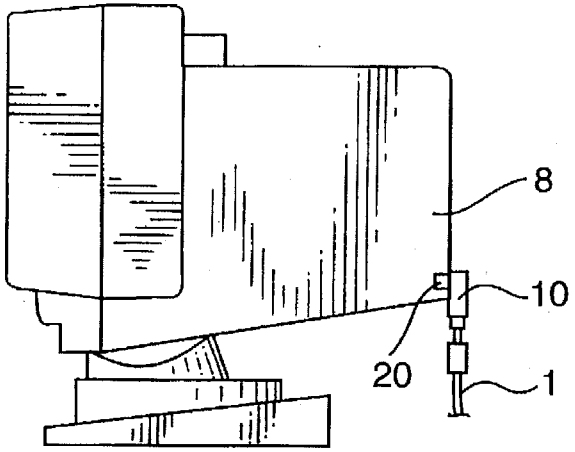
FIG. 6(A) is a side view of the cable connector of the present invention shown in a pivoted state in use with a monitor assembly.
Figure 6C:
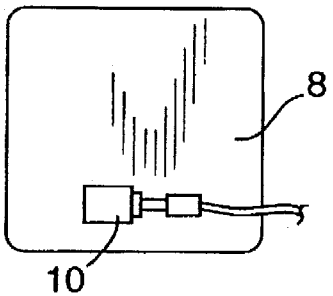
FIG. 6(C) is a schematic rear view of a variation of the plug-in cable connector when used with a monitor assembly.
Figure 6B:
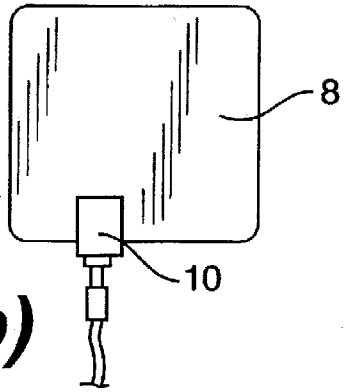
FIG. 6(B) is a schematic rear view of the cable connector and monitor assembly of FIG. 6(A).

When engagement portion 22 of head 20 is coupled to and inserted into a receptacle (not shown) associated with rear case section M of a monitor, head 20 is securely affixed to the receptacle so that housing 10 can pivot about the axis of shafts 23, 23'. As shown in FIGS. 6(A), 6(B) and 6(C), when a plug-in cable connector and a receptacle (not shown) are mated with each other in horizontal or vertical directions, housing 10 can pivot downward or in a direction of left or right, respectively.

As a result, housing 10 closely adjoins the backside wall of the rear case section of a monitor, rather than protruding perpendicularly from the backside wall surface. In addition, since a plurality of wires W are threaded through wire openings 23*c*, 23*c*' and thereby are contained and protected by cylindrical bodies 23*a*, 23*a*' of shafts 23, 23', wear or short-circuits caused by a rotary motion never occurs. Further, wires W do not rotate or twist due to their arrangement in substantially the center position of tubular bodies 23*a*, 23*a*' which prevents malfunction such as short circuits. Preventing twisting also lengthens the life of wires W.

Although the present invention has been described in terms of a connector for a monitor apparatus, the principles may be applied in any circumstance in which a cable is connected to electronic equipment.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

I claim:

1. A multiple pin cable connector including a housing for accommodating a plurality of electrically conductive wires connected to a signal cable, said wires being shielded by a copper sheet and being embedded in said housing by a molding and a head having an insertion portion for mating with a receptacle of a device, and a body, said connector comprising, housing means having a hollow formed at centered portion of upper portion thereof, for receiving said body and allowing a rotary motion of said head; and pivotable means provided with a shaft coupling for pivotably connecting said housing and said head, for accommodating the plurality of wires and leading the wires to be connected with corresponding respective pins enabling electrical continuity between said signal cable and said receptacle.

2. The multiple pin cable connector as claimed in claim 1, wherein a pair of flanges formed on both side ends of said coupling are inserted and engagedly locked onto axial holes formed at the center of inner side walls of both side portion of said body and at the center of both outer side walls of said body.

3. The multiple pin cable connector as claimed in claim 1, wherein said plurality of wires are divided and then threaded into wire opening formed in each of both sides of said coupling, to contact corresponding respective end of said pins.

4. The multiple pin cable connector as claimed in claim 1, wherein the lower portion of said body is generally curved.

5. A pivotable cable connector for connecting a signal cable to a receptacle in an electronic component, said connector including a housing for accommodating a plurality of electrically conductive wires connected to a signal cable and a copper sheet for shielding said wires, a head for leading said wires to the component receptacle, said connector comprising:

a turning hollow formed at an upper end of said housing for pivotably receiving said head;

a pivotable connection provided in said turning hollow between a lower body portion of said head and said housing whereby when said head is engaged to said component receptacle said pivotable connection enables said housing to pivot thereabout to bring said housing and said cable into close arrangement with said component.

6. The pivotable cable connector of claim 5, wherein said turning hollow is defined by a pair of opposing side posts on said upper end of said housing.

7. The pivotable cable connector of claim 6, wherein said pivotable connection comprises a tubular shaft provided at opposite ends of said lower body portion of said head, said tubular shafts defining a central axis and an axial opening provided on each of said side posts for receiving said tubular shafts thereby enabling said head and said housing to pivot about said central axis.

8. The pivotable cable connector of claim 7, wherein each said tubular shaft includes flanged ends to facilitate assembly said lower body portion of said head to said housing.

9. The pivotable cable connector of claim 7, wherein said tubular shafts contain said wires so that said wires are maintained at said central axis to prevent twisting and wear on said wires.

10. The pivotable cable connector of claim 5, wherein said pivotable connection provides a 180° pivoting range.

* * * * *